US005692228A

United States Patent [19]

Fukushima

[11] Patent Number: 5,692,228

[45] Date of Patent: Nov. 25, 1997

[54] PHOTOGRAPHIC FILM DEVELOPING APPARATUS

[75] Inventor: Shinji Fukushima, Wakayama, Japan

[73] Assignee: Noritsu Koki Co., Ltd., Wakayama-Ken, Japan

[21] Appl. No.: 194,945

[22] Filed: Feb. 14, 1994

[30] Foreign Application Priority Data

| | | | |
|---|---|---|---|
| Feb. 16, 1993 | [JP] | Japan | 5-026360 |
| Mar. 18, 1993 | [JP] | Japan | 5-057641 |
| Mar. 19, 1993 | [JP] | Japan | 5-059213 |

[51] Int. Cl.[6] ..... G03D 3/08

[52] U.S. Cl. ..... 396/613; 396/624; 242/595; 242/590

[58] Field of Search ..... 354/297, 313, 354/310, 317, 318–324, 331, 336, 337–340, 275; 352/78 R; 396/612, 613, 622, 937, 939, 940; 242/590, 523, 522, 615, 615.4, 595

[56] References Cited

U.S. PATENT DOCUMENTS

| | | | |
|---|---|---|---|
| 3,507,195 | 4/1970 | Fisnar et al. | 354/18 |
| 4,910,546 | 3/1990 | Nonaka et al. | 354/321 |
| 5,041,853 | 8/1991 | Kiejzik | 354/317 X |
| 5,083,721 | 1/1992 | Okutsu et al. | 354/275 X |
| 5,212,512 | 5/1993 | Shiota | 354/319 |
| 5,231,439 | 7/1993 | Takahashi et al. | 354/313 |
| 5,255,040 | 10/1993 | Pagano | 354/275 X |
| 5,257,065 | 10/1993 | Nagel | 355/28 |
| 5,385,317 | 1/1995 | Yamamoto et al. | 242/595 |

FOREIGN PATENT DOCUMENTS

| | | | |
|---|---|---|---|
| 463997 | 1/1992 | European Pat. Off. . | |
| 469594 | 2/1992 | European Pat. Off. . | |
| 502665 | 9/1992 | European Pat. Off. . | |
| 157843 | 6/1990 | Japan | 354/331 |

*Primary Examiner*—D. Rutledge

*Attorney, Agent, or Firm*—Townsend and Townsend and Crew LLP

[57] ABSTRACT

A photographic film developing apparatus includes a developing section including a developing tank for developing a photographic film strip, a drying section drying the developed film strip, and a film collecting/storing holder disposed adjacent an exit of the drying section for collecting and storing the dried film strip from the drying section. The film collecting/storing holder includes a film rolling device for rolling the film strip for the storage thereof within the holder.

12 Claims, 12 Drawing Sheets

PHOTOGRAPHIC FILM DEVELOPING APPARATUS

BACKGROUND OF THE INVENTION

1. Field of the Invention

The present invention relates to a photographic film developing apparatus.

2. Description of the Related Art

According to a photographic film developing apparatus developed by the prior art, a film retrieved from a cartridge is caused to pass, in succession, a plurality of independent developing tanks and then the developed film is dried for storage.

Further, the dried developed film is temporarily stored within a storage container commonly referred to as a film stocker having a capacity sufficient for preventing the stored film from being damaged through physical contact. In this, the film is kept, stored under a naturally warped state thereof until the film is withdrawn therefrom for a next processing step.

For the next process, the warped film strip is stretched straight and withdrawn under this state from the stocker to be subsequently conveyed to a site of the next process.

Therefore, the above-described convention requires a relatively large space for the temporary storage of the film. Further, since the film has to be once taken out of the film stocker to be conveyed to the next processing location, the transit operation of the film is time consuming. In these respects, the conventional art has room for improvement.

The present invention addresses to the above-described inconveniences. A primary object of the invention is to provide an improved developing apparatus of the above type which is capable of storing a dried developed film strip within a minimum space.

A further object of the invention is to provide an apparatus which facilitates the transportation of the film to a subsequent processing location thus achieving improvement in overall operation efficiency.

SUMMARY OF THE INVENTION

For fulfilling the above-identified objects, a photographic film developing apparatus, according to the present invention, comprises:

a developing section including a developing tank for developing a photographic film strip;

a drying section drying the developed film strip;

a film collecting/storing holder disposed adjacent an exit of the drying section for collecting and storing the dried film strip from the drying section;

wherein the film collecting/storing holder includes a film rolling means for rolling the film strip for the storage thereof within the holder.

According to the above-described construction, a developed and dried film strip is rolled by the film rolling means to be stored within the holder, such that the film under the rolled state may be stored in a compact manner within the holder.

According to one aspect of the invention, the film collecting/storing holder is detachable from the apparatus body. As the film can be conveniently transported under the above-described stored state within and together with the holder, this feature is advantageous for eliminating the necessity of withdrawal of the film from the holder for its transport to a next processing location.

Thus, the storage of the film under the rolled state can minimize the film storage space; and the detachable holder allows the film to be conveyed under the rolled state, thus improving the efficiency of film transport.

According to a further object of the invention, the film collecting/storing holder includes, inside thereof, a film guide face having a loop-like cross section. As the film withdrawn from the exit of the drying section is guided along the loop-like guide face, the film is rolled to be stored within the holder.

That is, as the dried film strip is continuously introduced into the holder, the film strip is automatically rolled for subsequent storage thereof within the holder.

As a result, through the simple arrangement of providing the loop-like film guide face inside the holder, the film strip may be stored under the rolled state inside the holder.

According to a still further aspect of the invention, the film rolling means includes a winder means having teeth engageable with a perforation of the film introduced into the holder and a drive means for driving the winder means for rotation.

With the above feature, as the film strip is introduced from the exit of the drying section, the perforation of the film strip is caught by the winder means; and with rotation of the winder means driven by the drive means, the film strip is wound and rolled about the winder means.

The above arrangement provides the advantage of positive catching of the introduced film strip. Thus, even in the case of a soft film strip of insufficient stiffness, this film strip may be reliably caught and rolled for the storage inside the holder, without possible trouble of collection failure that would otherwise tend to occur in such case.

According to a still further aspect of the invention, the film rolling means includes a winder means having a projection engageable with a hole defined in a film transport guide leader joined to the film strip and the drive means for driving this winder means for rotation.

With the above construction, when the film strip having been developed and dried at the drying section is exhausted from the exit of the drying section, the perforation of the film transport leader joined to this film is caught by the projection of the winder means provided inside the film collecting/storing holder, and as the winder means is driven to rotate by the drive means, the film is wound and rolled therein.

According to a further aspect of the invention, the apparatus further comprises a cutter disposed adjacent the exit of the drying section for cutting a film transport guide leader joined to the film strip off this film strip and an exhaust means for exhausting the cut leader away from a film transport path.

With the above-described construction, when the dried film strip from the drying section is transported to the location of the cutter, the cutter cuts the leader off the film strip and this cut leader is exhausted by the exhaust means away from the film transport path so as not to interfere with further transport of the film strip.

As a result, the film strip may be retrieved from the film developing apparatus with the leader being cut off the strip, so that the film strip may be ready for a subsequent process without requiring an additional operation for cutting the leader therefrom. Thus, the apparatus with this further feature may achieve further improvement in the operation efficiency.

Further and other objects, features and effects of the invention will become apparent from the following more detailed description of the embodiments of the invention with reference to the accompanying drawings.

BRIEF DESCRIPTION OF THE DRAWINGS

FIG. 16 is a schematic view showing a film transport mechanism of the apparatus of FIG. 13.

DESCRIPTION OF THE PREFERRED EMBODIMENTS

Preferred embodiments of a film developing apparatus relating to the present invention will be described in details with reference to the accompanying drawings.

Figure 1:
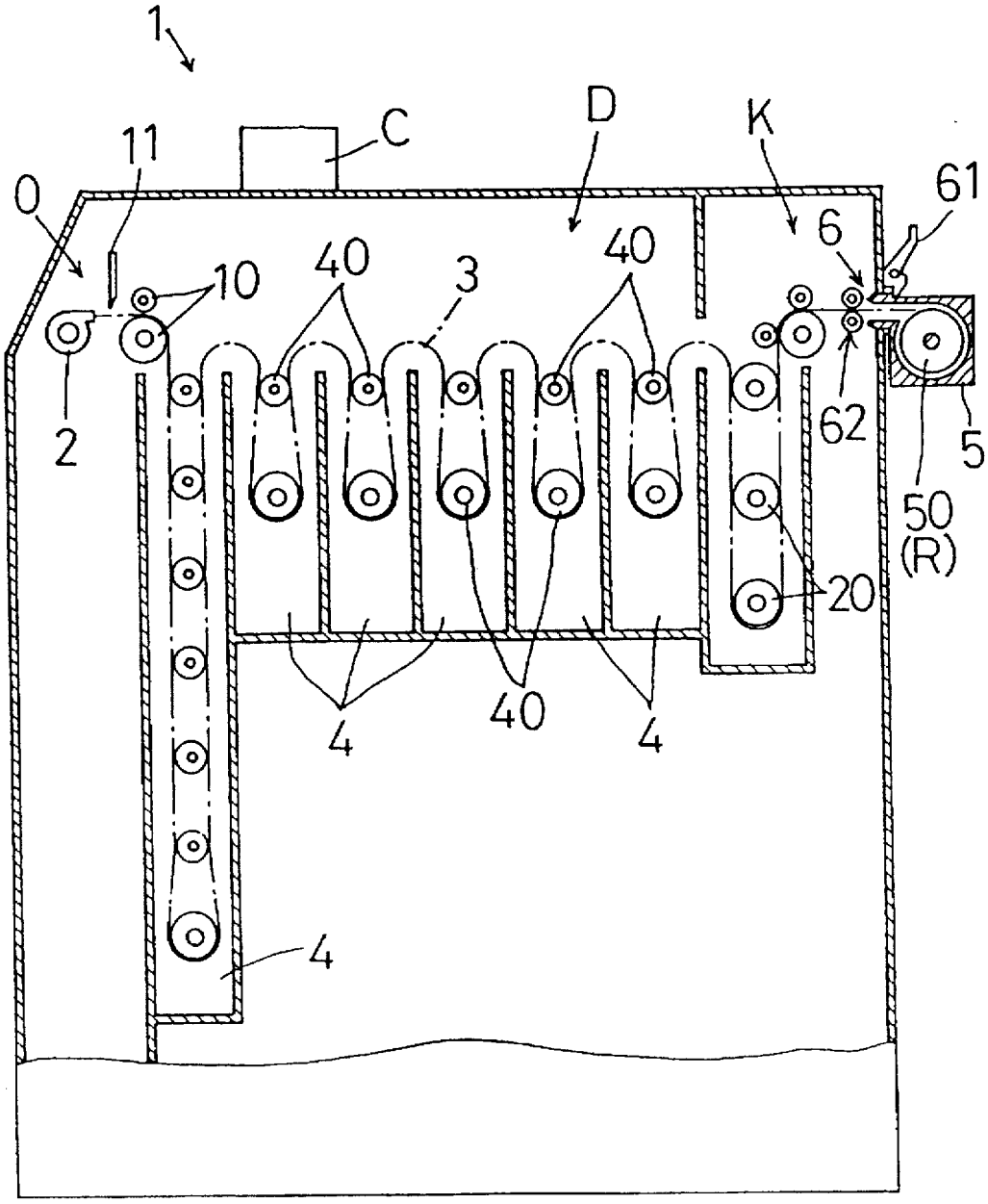
FIG. 1 is a schematic section showing a photographic film developing apparatus according to one preferred embodiment of the invention.

As shown in FIG. 1, a film developing apparatus 1 includes a film retrieving section O for retrieving a film strip 3 from a cartridge 2, a developing section D having a plurality of processing tanks 4, a drying section K for drying the developed film strip 3, a film collecting/storing holder 5 detachably attached to the body of the developing apparatus 1 for collecting and temporarily storing the dried film strip 3, and a control device C for controlling operations of the above-listed components.

The film strip 3 retrieved from the cartridge 2 at the film retrieving section O is subjected to a developing process with its successive passage through the processing tanks 4 of the developing section D and then is dried at the drying section K. Thereafter, this dried film strip 3 is collected and stored under a rolled state within the film collecting/storing holder 5. With completion of its storage into the holder 5, the film strip 3 inside and together with the holder 5 is detached from the body of the developing apparatus 1 to be transported to a location of a subsequent process, e.g. a printing process.

Next, the respective components will be described more specifically.

The film retrieving section O includes rollers 10 for advancing the film strip 3 retrieved out of the cartridge 2 and a cutter 11 for cutting a terminal end of the film strip 3 upon completion of the retrieval of the film 3 out, of the cartridge 2.

The developing section D includes the six developing tanks 4 respectively containing various film processing liquids, e.g. developing liquid, bleaching liquid, fixer liquid, stabilizer liquid, or the like.

Each of the processing tanks 4 includes rollers 40 for sending the film strip 3. Between these rollers 40, though not shown, there is provided a grooved guide for supporting opposed lateral edges of the film 3 by pinching the same.

The drying section K too includes similar rollers 20 to those of the processing tanks 4 and an unillustrated grooved guide.

Figure 2:
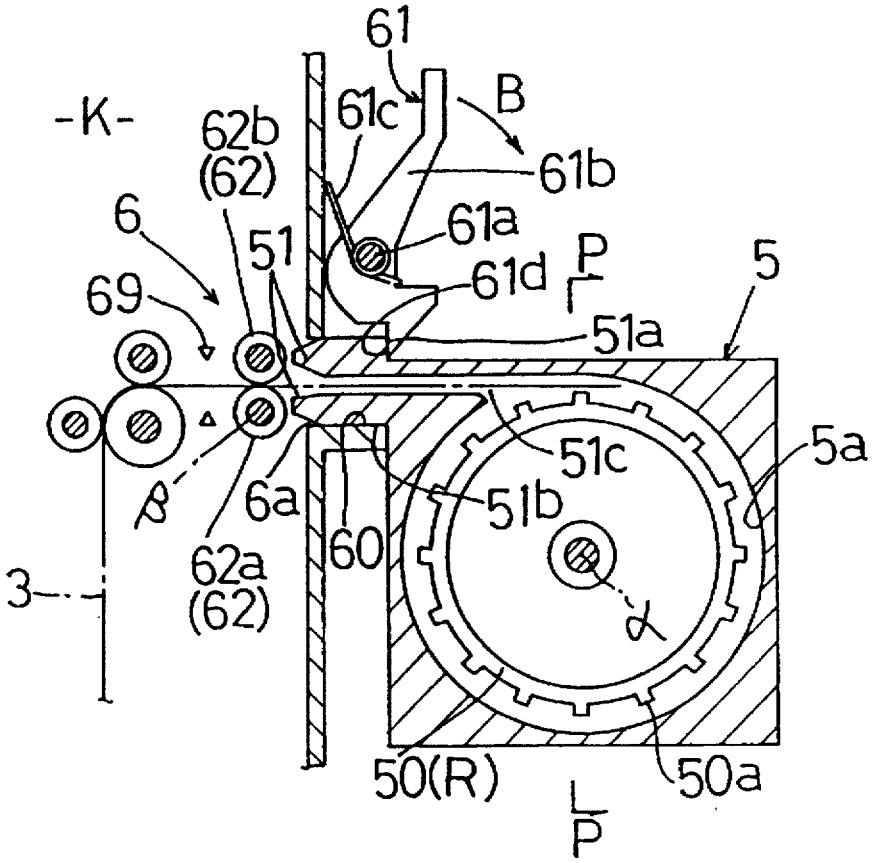
FIG. 2 is a side view in section showing major components of the apparatus of FIG. 1.
Figure 3:
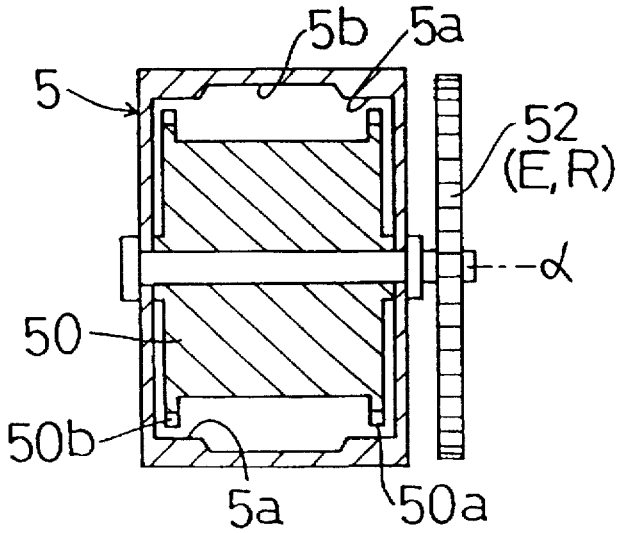
FIG. 3 is a section taken along a line P—P in FIG. 2.
Figure 4:
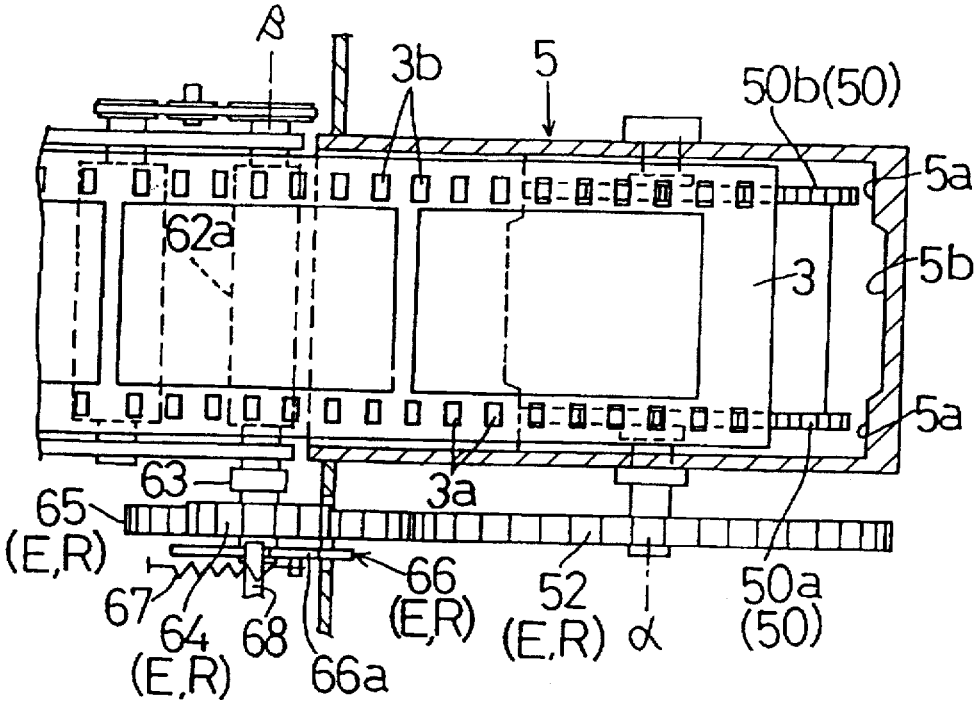
FIG. 4 is a plane view in section showing the major components of the apparatus of FIG. 1.
Figure 6:
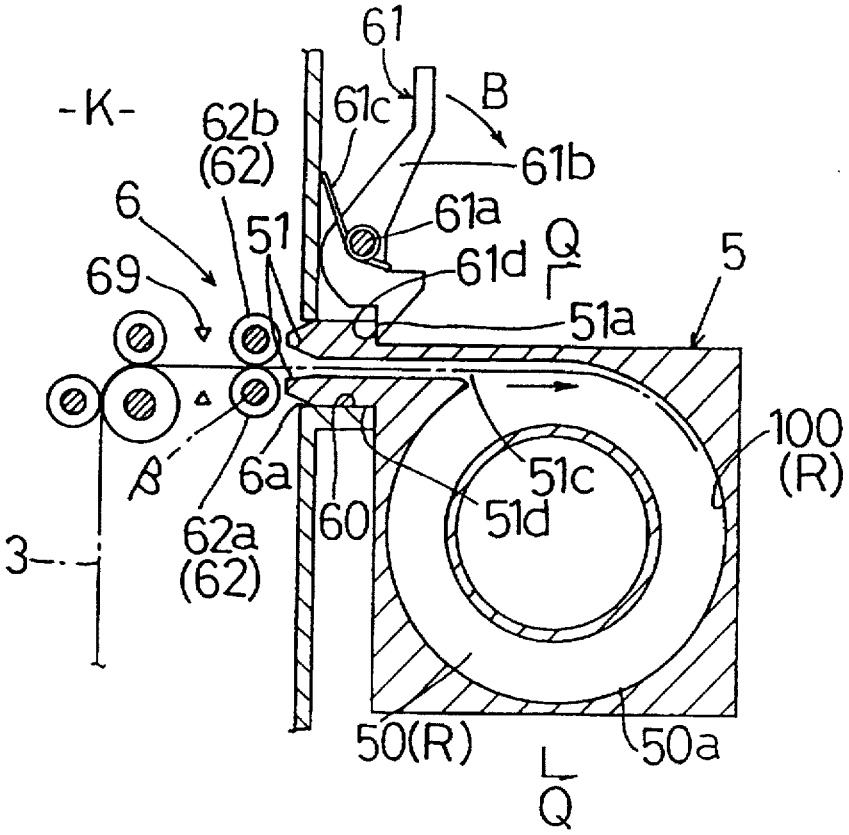
FIG. 6 is a side view in section showing major components of a photographic film developing apparatus according to a further embodiment of the invention.

At an exit 6 of the drying section K, as shown in FIG. 2, FIG. 3 which is a section taken along a line P—P in FIG. 2, and also in FIGS. 4 and 6, there are provided a pair of rollers 62 for sending the film strip 8 into the film collecting/storing holder 5. A drive gear 64 is attached via an electromagnetic clutch 63 to the lower roller 62*a* of the roller pair 62, with the gear 64 being attached along an axis β of rotation of the roller 62*a*. This drive gear 64 meshes with an intermediate gear 65; and these drive gear 64 and intermediate gear 65 are rotatably supported on a support plate 66, which in turn is pivotable about the rotation axis β when the electromagnetic clutch 63 is disengaged.

The support plate 66 includes an upper projection 66*a*, to which one terminal end of a spring 67 is connected. The other terminal end of this spring 67 is connected to the body of the developing apparatus 1.

Thus, the support plate 66 is urged by the spring 67 in a direction of an arrow A. The pivotal motion of the support plate 66 is restricted by abutment of the upper projection 66*a* against a stationary pin 68 fixed to the body of the developing apparatus 1.

Adjacent the exit 6 of the drying section K on the outside of the apparatus body, there is disposed a holder support 61 for pressing and supporting the film collecting/storing holder 5. This holder support 61 includes a cylindrical pin 61*a* secured to the apparatus body, a support arm 61*b* slidably rotatable about the cylindrical pin 61*a*, and a spring 61*c* having one terminal end connected to a lower portion of the cylindrical pin 61*a* and having the other terminal end connected to the apparatus body. The support arm 61*b* is urged by the spring 61*c* in a direction of an arrow B about the cylindrical pin 61*a*.

At a lower end of the support arm 61*b*, there is formed a pressing face 61*d* for pressing a portion of the film collecting/storing holder 5 for preventing inadvertent detachment of this holder 5.

The exit 6 of the drying section K includes a film collecting opening 6*a*, and at a lower edge of this opening 6*a*, there is formed a support face 60 for supporting a portion of the film collecting/storing holder 5.

On the upstream side of the transport passage of the film 3 relative to the rollers 62, there is provided a film sensor 69 for detecting presence/absence of the film 3.

As illustrated in FIGS. 2 through 5, the film collecting/storing holder 5 includes, at an upper corner region thereof, a projection 51 to be used for attachment and detachment of the holder to and from the developing apparatus body 1. More particularly, on an upper surface of the projection 51, there is formed a receiver face 51*a* which comes into engagement with the pressing face 61*d* of the holder support 61 disposed on the outside of the exit of the drying section K. On a lower surface of the projection 51, there is formed a support face 51*b* which comes into contact with the support face 60 of the exit 6 of the drying section K on the side of the developing apparatus body 1 thereby to support the film collecting/storing holder 5.

Inside the film collecting/storing holder 5, there is formed a cylindrical space; and an upper region of this space and the outside of the holder 5 are communicated with each other by way of a film passage 51*c* extending through the projection 51. In an inner wall 5*a* extending through this film passage 51*c* and the film collecting/storing holder 5, there is defined a groove 5*b* for preventing contact of the image-bearing area of the film strip 3.

Within the cylindrical space inside the film collecting/storing holder 5, there is provided a sprocket 50 acting as a film winder means for winding the film strip 3. The sprocket 50 includes, along opposed lateral peripheral portions thereof, a plurality of teeth 50*a*, 50*b* whose teeth forming pitch is equal to the pitch of perforations 3*a*, 3*b* formed along the side ends of the film strip 3. Also, the lateral distance between the teeth 50*a* and the teeth 50*b* is equal to the lateral distance between the perforations 3*a* and the perforations 3*b*.

On the outside of the film collecting/storing holder 5, there is provided a driven gear 52 operatively connected with the sprocket 50 along its rotation axis α. This driven gear 52 is meshed with the intermediate gear 65 attached to the support plate 66 when the the holder 5 is attached to the film developing apparatus body 1.

Incidentally, a gear ratio between the drive gear 64 on the side of the apparatus body 1 and the driven gear 52 on the side of the holder 5 is set such that a peripheral speed of the rollers 62 and that of the sprocket 50 are equal to each other.

Next, operations of the film developing apparatus 1 having the above-described construction will be specifically described.

The film strip 3, which has been continuously retrieved from the cartridge 2 by means of the rollers 10 of the film retrieving section O, is advanced to the developing section D. With withdrawal of the film strip from the cartridge 2 by a length corresponding to one film roll, with a cutting instruction from the control device C, the cutter 11 cuts the terminal end of the film strip 3, thereby to separate the film strip 3 from the cartridge 2.

At the next developing section D, the film 3 undergoes a developing process with its successive passage through the six processing tanks 4.

With completion of the developing process, the film 3 is sent to the drying section K to be dried.

As the film 3 is passed through the drying section K, a leading end of this dried film strip 3 is detected by the film sensor 69. Upon this detection, the control device C turns ON the electromagnetic clutch 63 to allow a driving force of the rollers 62 to be transmitted to the drive gear 64. This driving force is further transmitted via the intermediate gear 65 to the driven gear 52. With this, the sprocket 50 begins to rotate at a peripheral speed which is equal to the peripheral speed of the rollers 62.

As the film 3 is advanced by the rollers 62 through the film passage 51*c* into the film collecting/storing holder 5, the perforations 3*a*, 3*b* of this film strip 3 are caught by the respective teeth 50*a*, 50*b* of the sprocket 50 and the film 3 is rolled and wound within the film collecting/storing holder 5.

Next, when the terminal end of the film strip 3 is detected by the film sensor 69, the control device C turns OFF the electromagnetic clutch 63 after lapse of a time period corresponding to a time period measured from the instance of the detection of the terminal end until completion of its passage through the rollers 62. With this, the winding operation of the film 3 by the sprocket 50 is stopped and the collecting operation of the film 3 into the film collecting/storing holder 5 is completed. Incidentally, under this condition, the terminal end of the film strip 3 is not entirely wound into the holder 5, but slightly projects from the projection 51.

After completion of the collection of the film 3 into the film collecting/storing holder 5, an operator presses an approximate upper end region of the support arm 61*b* of the holder support 61 in the direction opposite to the direction of the arrow B thereby to release the engagement between the holder 5 and the apparatus body 1. Then, the operator may carry the detached holder 5 to a location of the next process.

Conversely, for attaching the film collecting/storing holder 5 to the film developing apparatus body 1, with keeping the approximate upper end region of the support arm 61*b* pressed in the direction opposite to the direction of the arrow B, the operator will insert the projection 51 into the opening 6*a* of the exit 6.

Accordingly, the electromagnetic clutch 63, drive gear 64, intermediate gear 65, support plate 66 and the driver, gear 52 together function as drive means E for driving the sprocket 50. And, rolling means R for causing the film strip 3 to be stored in a rolled state within the film collecting/storing holder 5 includes the drive means E and the sprocket 50.

Next, other embodiments of the invention will be specifically described.

Figure 7:
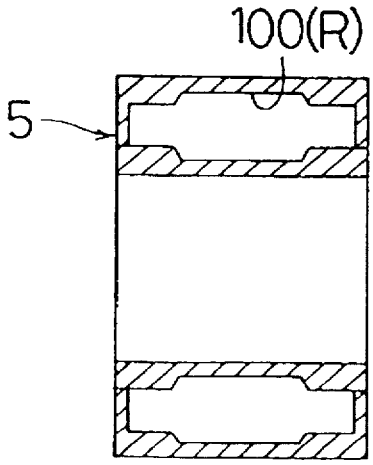
FIG. 7 is a section taken along a line Q—Q in FIG. 6.

(1) In the foregoing embodiment, the rolling means R includes the sprocket 50 and the drive means E for driving the sprocket 50 instead, as shown in FIG. 6 and also in FIG. 7 which comprises a section taken along a line Q—Q in FIG. 6, the film collecting/storing holder 5 may include an interior having a doughnut-like cross section with a central circular space and an inner wall having a loop-like cross section so as to act as a guide face 100 for guiding the film strip 3 introduced into the holder 5. Further, it is preferred that the film collecting/storing holder 5 be formed of a material of low frictional resistance, e.g. polyethylene for allowing smooth introduction of the film strip 3.

Incidentally, the configuration of the inner wall of this film collecting/storing holder is not particularly limited to the approximately circular configuration shown in FIG. 6, but may be e.g. a polygonal configuration as long as the same is loop-like.

In place of forming the guide face 100 by the inner wall of the film collecting/storing holder 5, a guide face 100 having the same configuration as said one may be provided independently of the inner wall.

(2) In the foregoing embodiment, the drive means E for driving the sprocket 50 of the film collecting/storing holder 5 comprises the gears or the like. Instead, it is also conceivable to provide the film collecting/storing holder with a motor for driving the sprocket 50.

(3) In the foregoing embodiment, the film strip 3 is wound by the rotational drive of the sprocket 50 inside the film collecting/storing holder 5. Alternatively, a roller, e.g. a rubber roller, may be employed instead of the sprocket having the teeth 50*a*, 50*b*. In operation, as the film strip 3 is fed into the film collecting/storing holder 5, the film strip 3 is rolled therein. Then, as the diameter of the film roll becomes smaller inside the holder, the rolled film 3 comes into firm contact with the rotating roller to be rolled and wound around the same.

(4) In the foregoing embodiment, the driven gear 52 provided on the side of the film collecting/storing holder 5 is provided integrally with this holder 5, such that the driven gear 52 is detached from the film developing apparatus body 1 together with the film collecting/storing holder 5. Alternatively, the driven gear 52 may be supported to the film developing apparatus body 1, with the driven gear 52 being spline-engageable with the rotation-drive shaft of the sprocket 50. Then, for detaching the film collecting/storing holder 5 from the film developing apparatus body 1, the rotation-drive shaft of the sprocket 50 is withdrawn from the driven gear 52, so that the film collecting/storing holder 5 may be transported without the driven gear.

(5) In the foregoing embodiment, the winder means comprises the sprocket 50. Instead, it is conceivable to employ a belt having, in its outer surface, teeth matching the perforations 3*a*, 3*b* of the film 3, with the belt being entrained about. e.g. pulleys to be driven by a motor.

(6) A still further embodiment of the present invention will be described in details with reference to the accompanying drawings.

Figure 8:
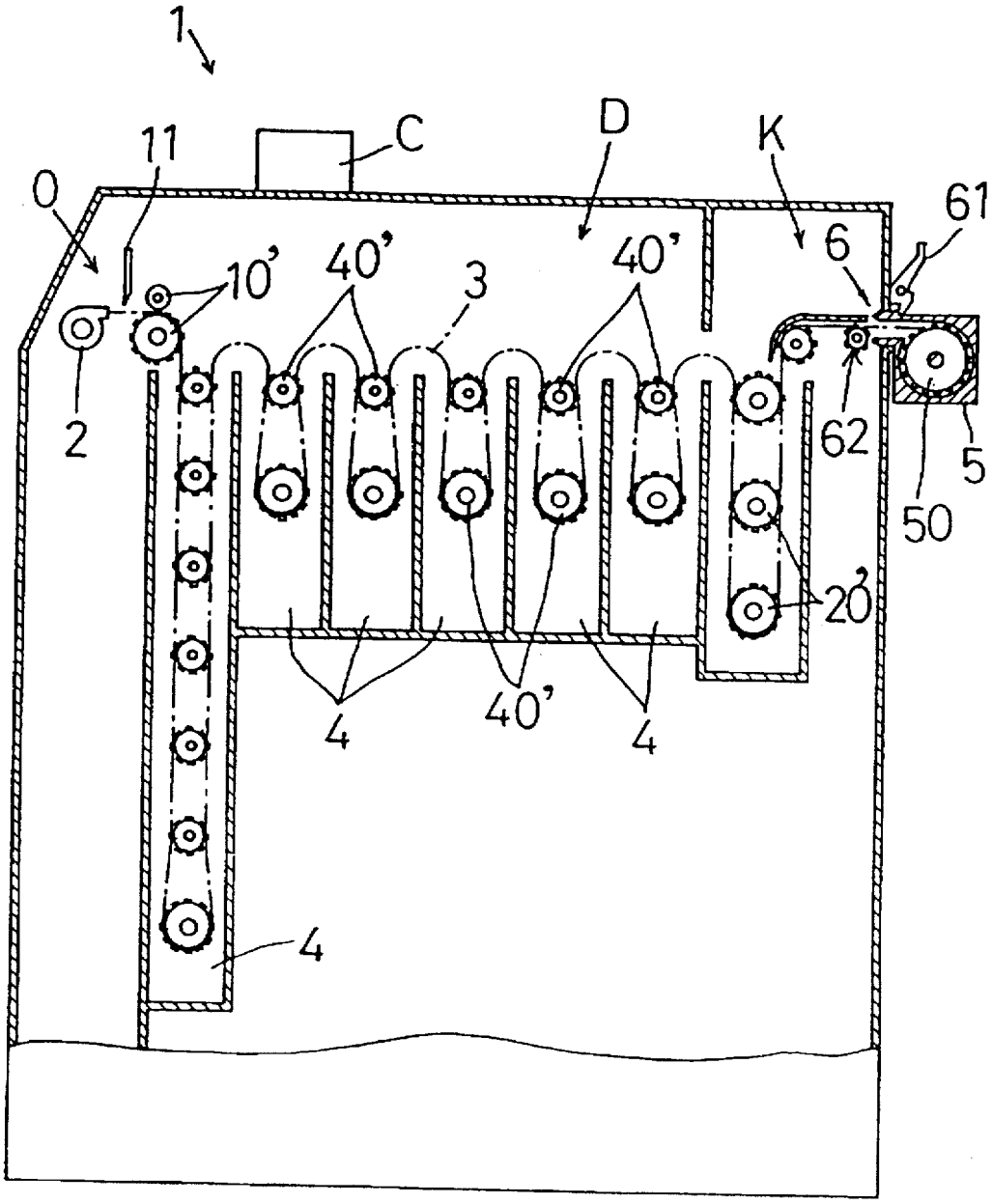
FIG. 8 is a schematic section showing major components of a photographic film developing apparatus according to a still further embodiment of the invention.

As shown in FIG. 8, a film developing apparatus 1 includes a film retrieving section O for retrieving a film strip 3 from a cartridge 2, a developing section D having a plurality of processing tanks 4, a drying section K for drying the developed film strip 3, a film collecting/storing holder 5 detachably attached to the body of the developing apparatus 1 for collecting and temporarily storing the dried film strip 3, and a control device C for controlling operations of the above-listed components.

The film strip 3 retrieved from the cartridge 2 at the film retrieving section O is subjected to a developing process with its successive passage through the processing tanks 4 of the developing section D and then is dried at the drying section K. Thereafter, this dried film strip 3 is collected and stored under a rolled state within the film collecting/storing holder 5. With completion of its storage into the holder 5, the film strip 3 inside and together with the holder 5 is detached from the body of the developing apparatus 1 to be transported to a location of a subsequent process, e.g. a printing process.

Figure 11:
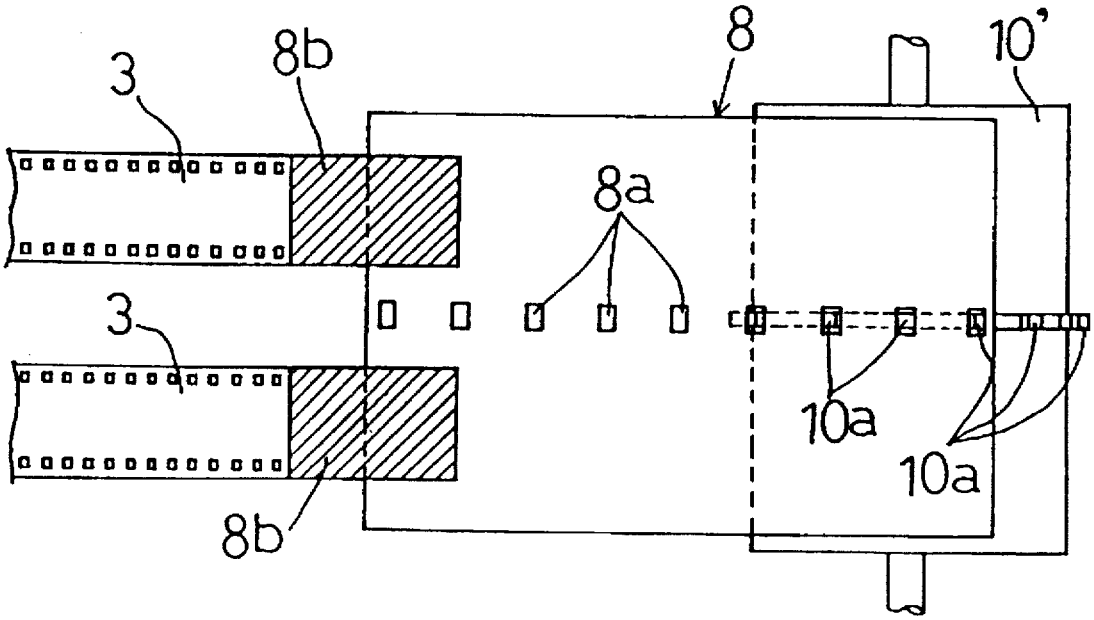
FIG. 11 is a view showing joint between a film strip and a guide leader used in the apparatus of FIG. 8.

As shown in FIG. 11, in order to transport two film strips 3 arranged side by side and joined to a transport guide leader 8, a roller 10' includes teeth 10*a* for catching and sending a series of perforations 8*a* defined at the central region of the leader 8. Further, two of the cutters 11 are provided for cutting the two rows of film strips 3 respectively.

A further roller 40' of the processing tank has a similar construction as the above-described roller 10' so as to transport the two rows of film strips joined to the leader 8.

The drying section K too includes similar rollers 20' to those of the processing tanks 4 and an unillustrated grooved guide.

Figure 9:
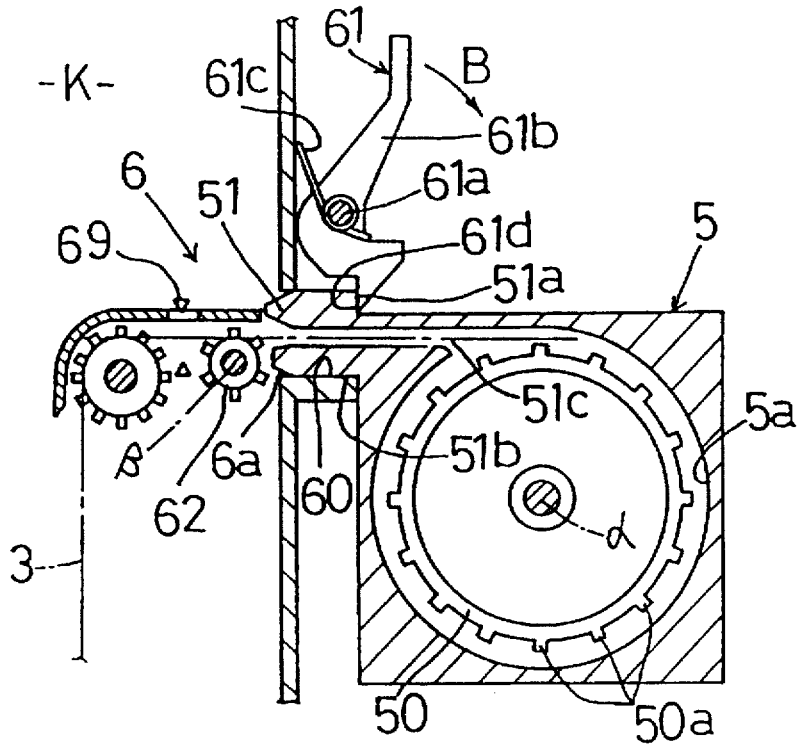
FIG. 9 is a side view in section showing the major components of the apparatus of FIG. 8.
Figure 10:
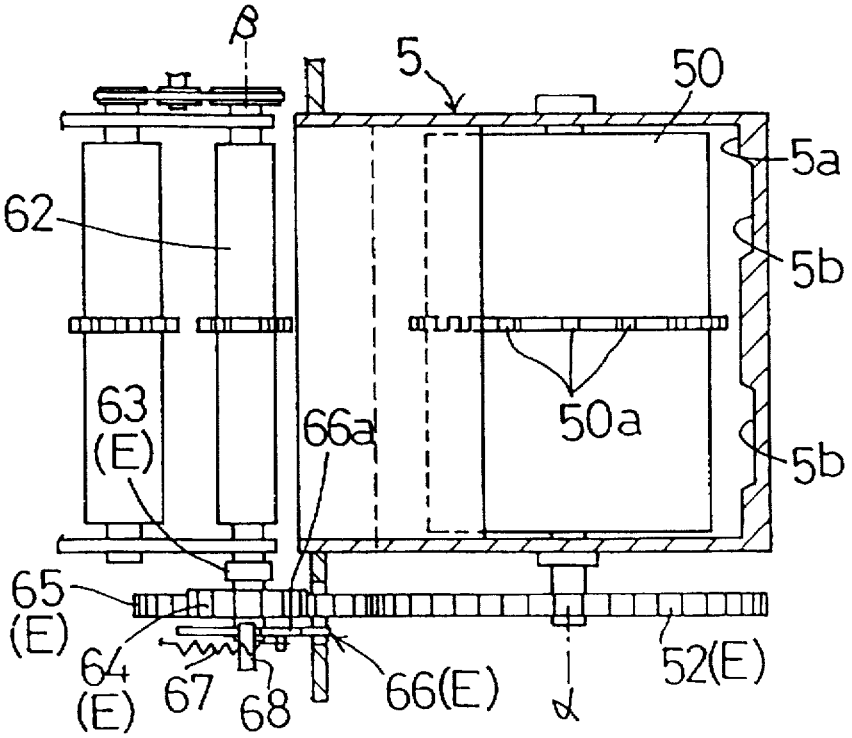
FIG. 10 is a plane view in section showing the major components of the apparatus of FIG. 8.

At an exit 6 of the drying section K, as shown in FIGS. 9 and 10, there is provided a roller 62 for sending the film strips 3 into the film collecting/storing holder 5. A drive gear 64 is attached via an electromagnetic clutch 63 to the roller 64, with the gear 64 being attached along an axis β of rotation of the roller. This drive gear 64 meshes with an intermediate gear 66; and these drive gear 64 and intermediate gear 65 are rotatably supported on a support plate 66, which in turn is pivotable about the rotation axis β when the electromagnetic clutch 63 is disengaged.

Figure 5:
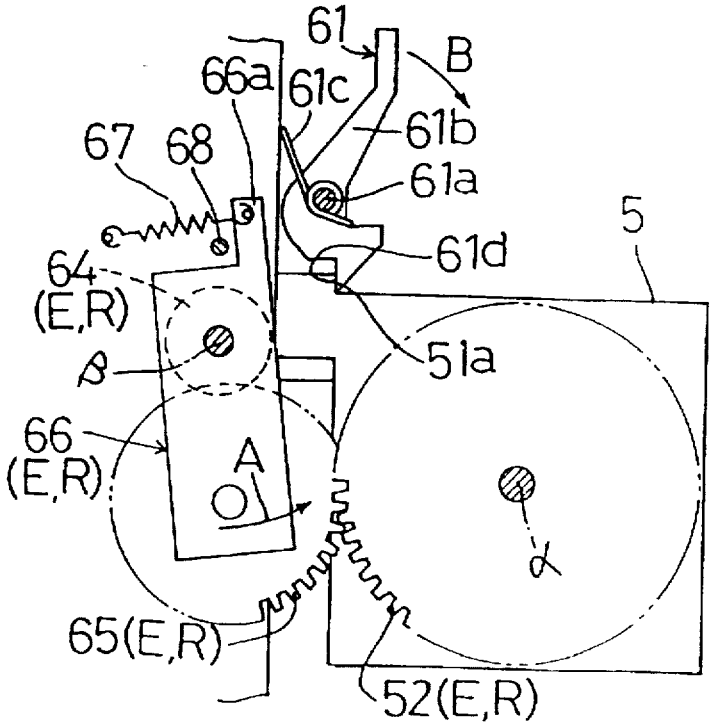
FIG. 5 is a further side view in section showing the major components of the apparatus of FIG. 1.

The support plate 66 includes an upper projection 66*a*, to which one terminal end of a spring 67 is connected as shown in FIG. 5. The other terminal end of this spring 67 is connected to the body of the developing apparatus 1.

Thus, the support plate 66 is urged by the spring 67 in a direction of an arrow A. The pivotal motion of the support, plate 66 is restricted by abutment of the upper projection 66*a* against a stationary pin 68 fixed to the body of the developing apparatus 1.

Adjacent the exit 6 of the drying section K on the outside of the apparatus body, as shown in FIG. 9, there is disposed a holder support 61 for pressing and supporting the film collecting/storing holder 5. This holder support 61 includes a cylindrical pin 61*a* secured to the apparatus body, a support arm 61*b* slidably rotatable about the cylindrical pin 61*a*, and a spring 61*c* having one terminal end connected to a lower portion of the cylindrical pin 61*a* and having the other terminal end connected to the apparatus body. The support arm 61*b* is urged by the spring 61*c* in a direction of an arrow B about the cylindrical pin 61*a*.

At a lower end of the support arm 61*b*, there is formed a pressing face 61*d* for pressing a portion of the film collecting/storing holder 5 for preventing inadvertent detachment of this holder 5.

The exit 6 of the drying section K includes a film collecting opening 6*a*, and at a lower edge of this opening 6*a*, there is formed a support face 60 for supporting a portion of the film collecting/storing holder 5.

On the upstream side of the transport passage of the roller 62 for the films 3, there is disposed a film sensor 69 for detecting presence/absence of the film strips 3. This film sensor 69 is so designed as not to detect the leader 8 which is transparent, but to detect splice portions 8*b*, which comprise the joining portions between the film strips 3 and the leader 8.

As illustrated in FIGS. 9, the film collecting/storing holder 5 includes, at an upper corner region thereof, a projection 51 to be used for attachment and detachment of the holder to and from the developing apparatus body 1. More particularly, on an upper surface of the projection 51, there is formed a receiver face 51*a* which comes into engagement with the pressing face 61*d* of the holder support 61 disposed on the outside of the exit of the drying section K. On a lower surface of the projection 51, there is formed a support face 51*b* which comes into contact with the support face 60 of the exit 6 of the drying section K on the side of the developing apparatus body 1 thereby to support the film collecting/storing holder 5.

Inside the film collecting/storing holder 5, there is formed a cylindrical space; and an upper region of this space and the outside of the holder 5 are communicated with each other by way of a film passage 51*c* extending through the projection 51. In an inner wall 5*a* extending through this film passage 51*c* and the film collecting/storing holder 5, there is defined a groove 5*b* for preventing contact of the image-bearing areas of the film strips 3.

Within the cylindrical space inside the film collecting/storing holder 5, there is provided a sprocket 50 acting as a film winder means for winding the film strip 3. The sprocket 50 includes, at a central peripheral portion thereof, a plurality of teeth 50*a* whose teeth forming pitch is equal to the pitch of perforations 8*a* formed along the central region of the leader 8 joined to the film strips 3.

On the outside of the film collecting/storing holder 5, there is provided a driven gear 52 operatively connected with the sprocket 50 along its rotation axis α. This driven gear 52 is meshed with the intermediate gear 65 attached to the support plate 66 when the the holder 5 is attached to the film developing apparatus body 1.

Incidentally, a gear ratio between the drive gear 64 on the side of the apparatus body 1 and the driven gear 52 on the side of the holder 5 is set such that a peripheral speed of the roller 62 and that of the sprocket 50 are equal to each other.

Next, operations of the film developing apparatus 1 having the above-described construction will be specifically described.

When two cartridges 2 each accommodating the film strip 3 having its leading end joined to the leader 8 are set inside the film developing apparatus, the film strips 3 are retrieved from the respective cartridges 2 by means of the roller 10' of the film retrieving section O. Then, the films are advanced to the developing section D. With withdrawal of the film strips from the cartridges 2 by a length corresponding to one film roll respectively, with a cutting instruction From the control device C, the cutters 11 provided respectively for the two Film strips 3 cut the terminal ends of the film strips 3, thereby to separate the film strips 3 from the respective cartridges 2.

At the next developing section D, the films 3 undergo a developing process with their successive passage through the six processing tanks 4.

With completion of the developing process, the films 3 are sent to the drying section K to be dried.

As the film strips 3 are passed through the drying section K, leading ends of these dried film strips 3 are detected by the film sensor 69. Upon this detection, the control device C turns ON the electromagnetic clutch 63 to allow a driving force of the roller 62 to be transmitted to the drive gear 64. This driving force is further transmitted via the intermediate gear 65 to the driven gear 52. With this, the sprocket 50 begins to rotate at a peripheral speed which is equal to the peripheral speed of the roller 62.

As the films 3 are advanced by the roller 62 through the film passage 51 into the film collecting/storing holder 5, the perforations 8*a* of the leader 8 are caught by the teeth 50*a* of the sprocket 50 and the films 3 are rolled and wound within the film collecting/storing holder 5.

Next, when the terminal ends of the film strips 3 are detected by the film sensor 69, the control device C turns OFF the electromagnetic clutch 63 after lapse of a time period corresponding to a time period measured from the instance of the detection of the terminal ends until completion of their passage through the roller 62. With this, the winding operation of the films 3 by the sprocket 50 is stopped and the collecting operation of the films 3 into the film collecting/storing holder 5 is completed. Incidentally, under this condition, the terminal ends of the film strips 3 are not entirely wound into the holder 5, but slightly project from the projection 51.

After completion of the collection of the films 3 into the film collecting/storing holder 5, an operator presses an approximate upper end region of the support arm 61*b* of the holder support 61 in the direction opposite to the direction of the arrow B thereby to release the engagement between the holder 5 and the apparatus body 1. Then, the operator may carry the detached holder 5 to a location of the next process.

Conversely, for attaching the film collecting/storing holder 5 to the film developing apparatus body 1, with keeping the approximate upper end region of the support arm 61*b* pressed in the direction opposite to the direction of the arrow B, the operator will insert the projection 51 into the opening 6*a* of the exit 6.

Accordingly, the electromagnetic clutch 63, drive gear 64, intermediate gear 65, support plate 66 and the driven gear 52 together function as drive means E for driving the sprocket 50.

Figure 12:
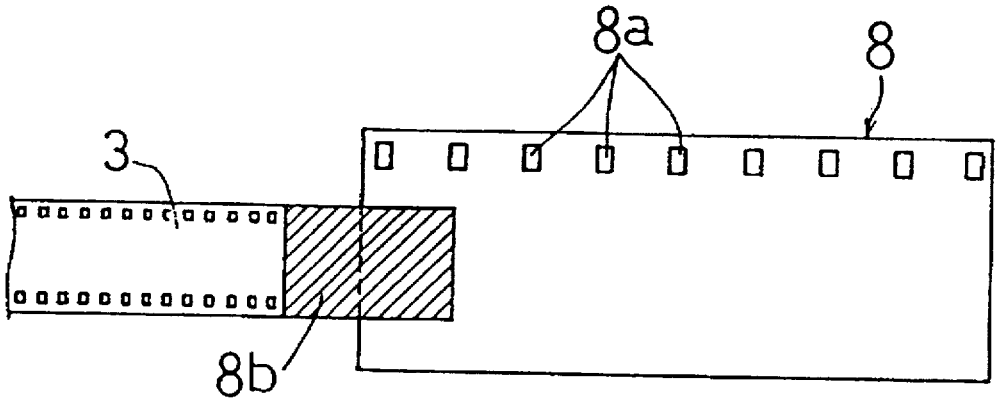
FIG. 12 is a view showing joint between a film strip and a guide leader according to a further embodiment of the invention.

(7) In the above-described embodiment, two rows of film strips 3 are joined to the leader 8 to be developed together. Instead, more than three film strips 3 may be joined to the leader 8 for the development. In case one film strip 3 is joined to the leader 8 for the development, as shown in FIG. 12, the series of perforations 8*a* of the leader 8 may be defined adjacent either side end region of the same, with the teeth of the rollers and the sprocket 50 being set to be aligned thereto.

(8) In the foregoing embodiments, the sprocket 50 is employed for the means provided to the film collecting/storing holder 5 for winding the leader-joined films. The specific construction of this film winder means is not limited thereto, but may be any rotary member having projections. Further, in the foregoing embodiments, the drive means E for driving the sprocket 50 comprise the gears or the like. Alternatively, it is conceivable to provide the film collecting/storing holder 5 with a motor for driving the sprocket.

(9) A still further embodiment of the invention will be described next.

Figure 13:
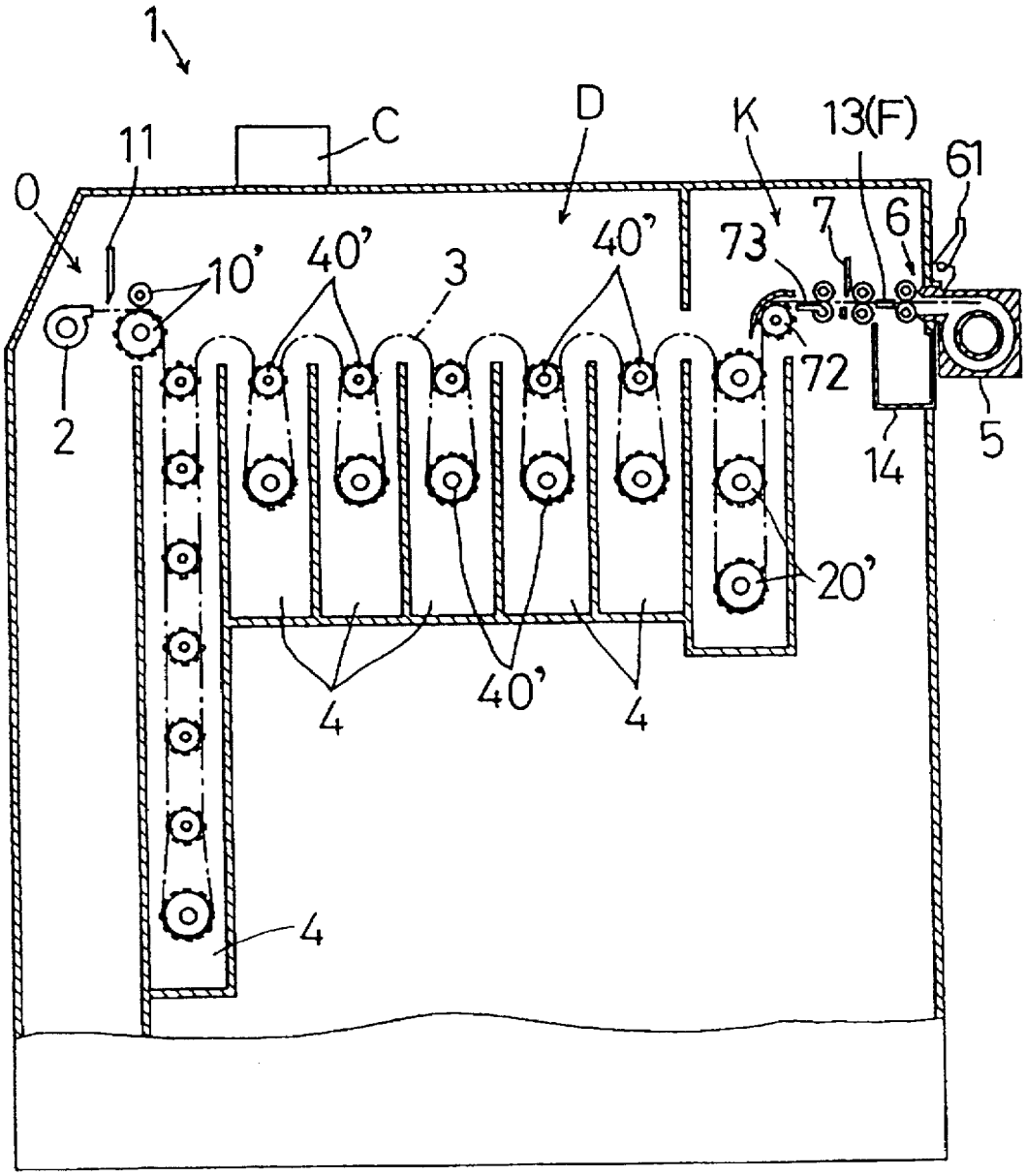
FIG. 13 is a schematic section showing a photographic film developing apparatus according to a still further embodiment of the invention.

As shown in FIG. 13, this film developing apparatus 1 includes a film retrieving section O for retrieving a film strip 3 from a cartridge 2, a developing section D having a plurality of processing tanks 4, a drying section K for drying the developed film strip 3, a cutter 7 for cutting a leader 8 off a film strip 3 having its leading end joined to the leader 8 after the drying operation, a film collecting/storing holder 5 detachably attached to the body of the developing apparatus 1 for collecting and temporarily storing the dried film strip 3, and a control device C for controlling operations of the above-listed components.

The film strip 3 retrieved from the cartridge 2 at the film retrieving section O is subjected to a developing process with its successive passage through the processing tanks 4 of the developing section D and then is dried at the drying section K. Then, the leader 8 is cut off the film strip 3 by the cutter 7. Thereafter, this film strip 3 is collected and stored under a rolled state within the film collecting/storing holder 5. With completion of its storage into the holder 5, the film strip 3 inside and together with the holder 5 is detached from the body of the developing apparatus I to be transported to a location of a subsequent process, e.g. a printing process.

As shown in FIG. 11, in order to transport two film strips 3 arranged side by side and joined to a transport guide leader 8, a roller 10' includes teeth 10*a* for catching and sending a series of perforations 8*a* defined at the central region of the leader 8. Further, two of the cutters 11 are provided for cutting the two rows of film strips 3 respectively.

Each processing tank 4 includes a roller 40'. Between the adjacent rollers 40', though not shown, there is provided a groove-like guide for pinching and supporting opposed side ends of the leader 8. This roller 40' too has a similar construction as the above-described roller 10' so as to transport the two rows of film strips joined to the leader 8.

Figure 14:
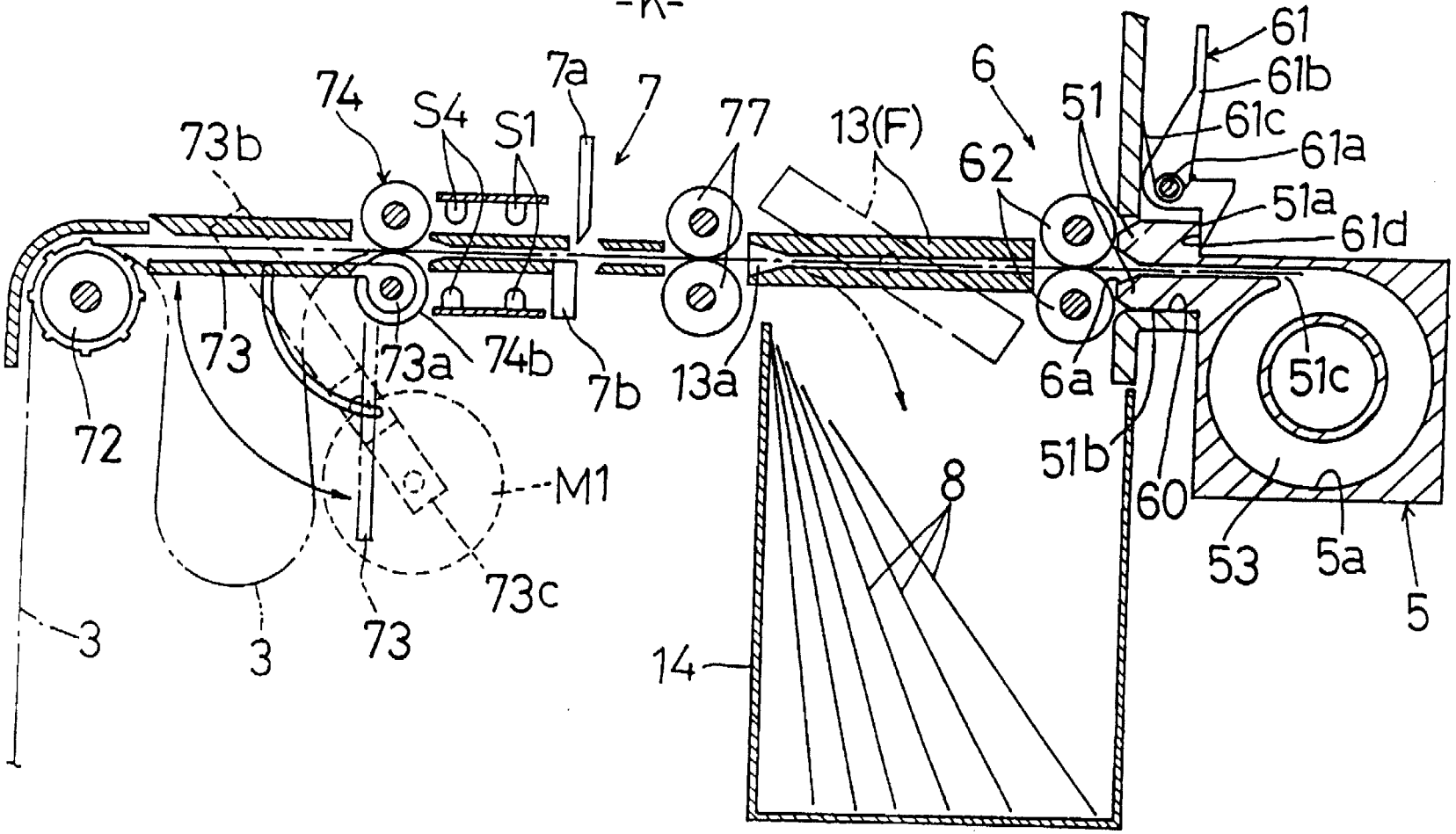
FIG. 14 is a side view in section showing major components of the film developing apparatus of FIG. 13.

At an exit 6 of the drying section K, as shown in FIG. 14, on the downstream side of the transport passage of the film strips 3 of a roller 72, there is provided a plate-like loop guide 73 for adjusting a transport speed of the film strips 3. This loop guide 73 has its base end 73*a* loosely mounted on a rotation shaft of a lower roller 74*b* of roller pair 74, so that the guide 73 is pivotable.

Figure 15:
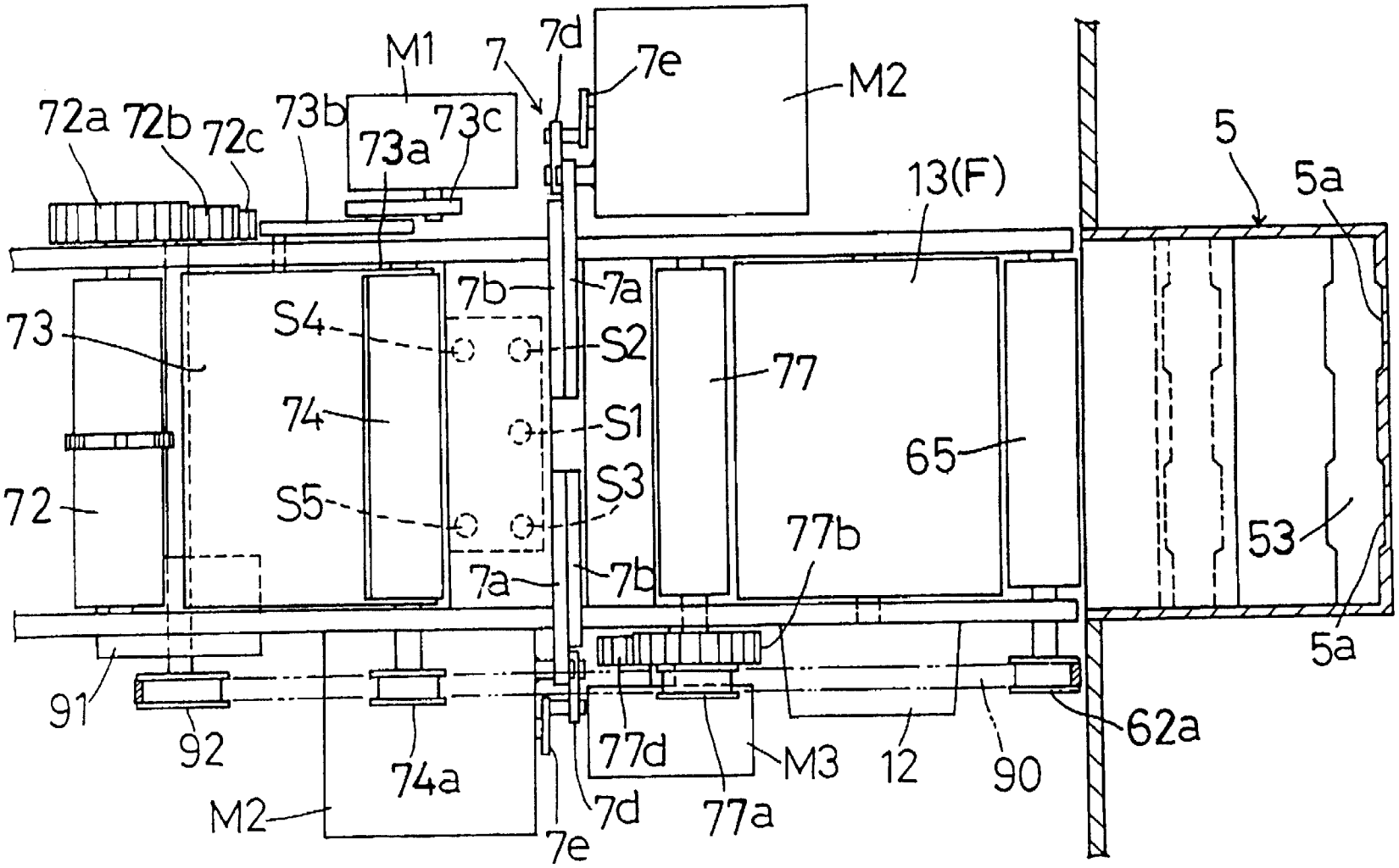

As shown in FIGS. 14 and 15, the loop guide 73 is connected with a loop-guide drive motor M1 via a link mechanism comprised of two link plates 73*b*, 73*c* pivotably connected to each other. A terminal end of the link plate 73*b* on the side of the loop guide 73 is attached to an approximate central portion of the loop guide 73 to be pivotable about a rotation axis along the width of the film 3. A terminal end of the link plate 73*c* on the side of the loop-guide drive motor M1 is fixed to the rotation shaft of the loop-guide drive motor M1.

Then, with rotation drive of this loop-guide drive motor M1, the loop guide 73 is switched over between a posture denoted by a solid line in FIG. 14 extending along the transport passage of the films 3 and a further downwardly opened posture denoted by a two-dot chain line in FIG. 14.

On the downstream side of the loop guide 73 in the transport passage of the films 3, there are disposed an optical sensor S1 for detecting presence/absence of the leader 8, optical sensors S2, S3 for detecting the respective splice portions 8*b* joining between the film strips 3 and the leader 8, and further optical sensors S4, S5 for detecting the respective terminal ends of the two film strips 3. Incidentally, the splice portions 8*b* have a lower light-transmittance than the leader 8. So that, the sensitivity of the optical sensors S2, S3 for detecting the splice portions 8*b* is so adjusted as not to detect the leader 8, but to detect the splice portions 8*b*.

On the downstream side of the loop guide 73 in the transport passage of the film strips 3, there is provided the cutter 7 for cutting the film strips 3 from the leader 8.

Figure 17:
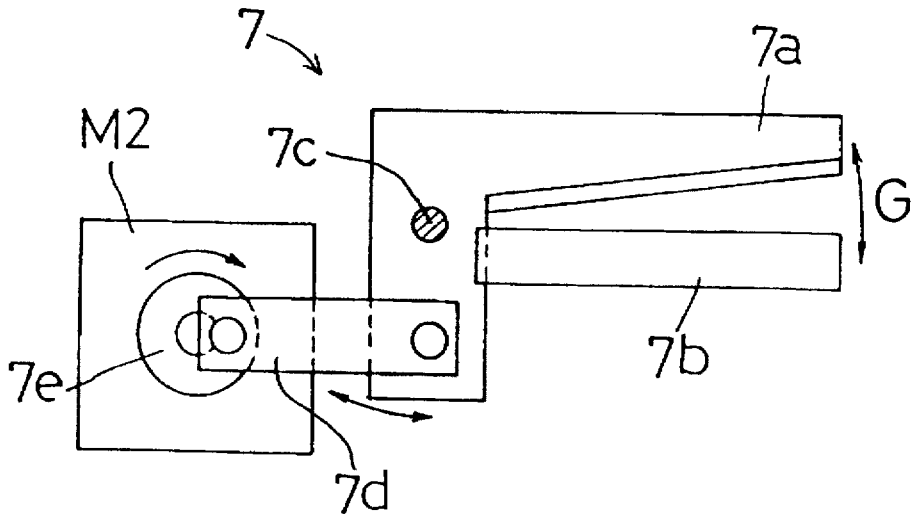
FIG. 17 is a schematic view showing a cutter of the apparatus of FIG. 13.

This cutter 7, as shown in FIGS. 15 and 17, includes an upper blade 7*a* driven by a cutter-drive motor M2 and a lower blade 7*b* fixed to the downstream portion of the transport passage of the film strips 3.

The upper blade 7*a* of the cutter 7, as shown in FIG. 17, is attached to a cutter-attaching shaft 7*c* fixed to the film developing apparatus body 1 to be pivotable in a direction denoted by an arrow C.

With rotational drive of the cutter-driving motor M2, the upper blade 7*a* of the cutter 7 is pivoted about the cutter-attaching shaft. 7*c* in the direction of an arrow G to cut a portion adjacent the splice portions 8*b* positioned between the upper blade 7*a* and the lower blade 7*b*, thereby to separate the films 3 from the leader 8.

On the downstream side of the cutter 7 in the transport passage of the film strips 3, as shown in FIG. 15, there is provided a swing guide 13 which is fixed to a drive shaft 12*a* for a solenoid 12 to be pivoted in association with drive of this solenoid 12.

In association with the drive of the solenoid 12, the swing guide 13 is switched over between a posture denoted by a solid line in FIG. 14 extending along the transport passage of the film strips 3 and a further posture denoted by a two-dot chain line in FIG. 14 displaced from the film transport passage.

More particularly, when the solenoid 12 is in the state of 'OFF', the swing guide 13 assumes the posture extending along the transport passage of the films 3, so that the coming film strips 3 are caused to pass through a film passage 13*a* inside the swing guide 13. On the other hand, when the solenoid 12 is in the state of 'ON', the swing guide 13 is displaced from the film transport, passage, so that a side of the guide is raised relative to the transport passage of the films 3. Thus, when the leader 8 cut by the cutter 7 is transported to the swing guide, the swing guide 13 causes this leader 8 to be dropped into a leader collecting box 14 disposed under the swing guide 13.

Figure 16:
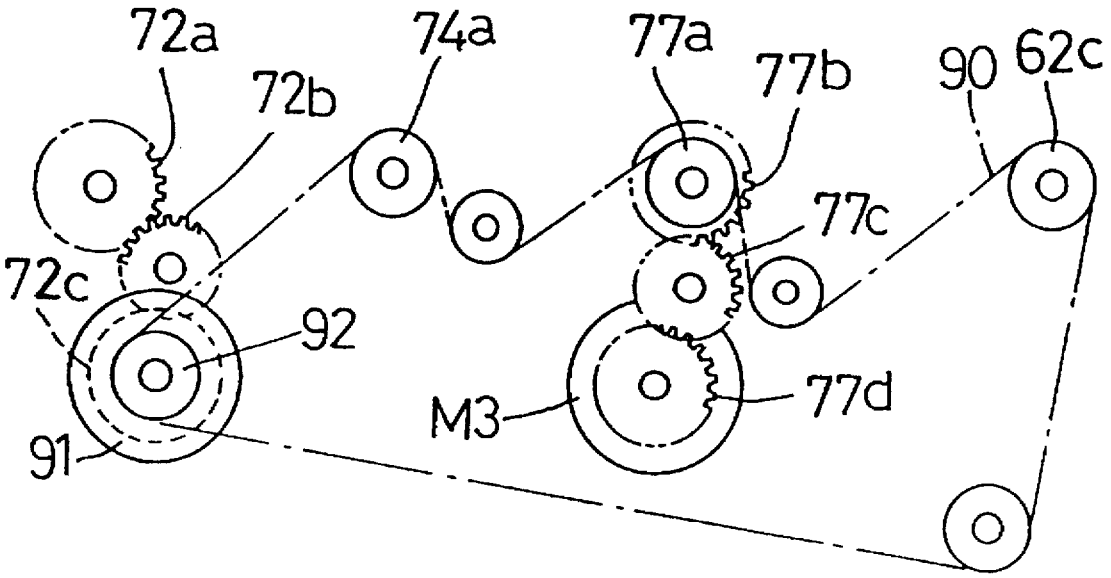
FIG. 16 is a plane view in section showing major components of the film developing apparatus of FIG. 13.

As illustrated in FIGS. 15 and 16, the roller 72 coaxially carries a gear 72*a*, which in turn is connected with a belt-drive gear 72*c* via an intermediate gear 72*b*. A belt-drive pulley 92 is provided coaxially with the belt-drive gear 72*c* by way of an electromagnetic clutch 91.

A timing belt 90 is entrained about the belt-drive pulley 92 and further pulleys 74*a*, 62*c*, 77*a* coaxially connected respectively with a roller 74, a roller 77 positioned between the cutter 7 and the swing guide 13 and the roller 62 for introducing the films 3 into the film collecting/storing holder 5.

With the above, in association with ON/OFF of the electromagnetic clutch 91, the drive force applied to the roller 72 is selectively transmitted to one of the rollers 62, 74, 77.

The roller 77 is operatively connected with a gear 77*b* as well as with the pulley 77*a*. The gear 77*b* is connected through an intermediate gear 77*c* to a drive gear 77*d* which in turn is connected with a leader-transport motor M3.

Between the pulley 77*a* and the roller 77 and between the gear 77*c* and the roller 77, unillustrated one-way clutches are interposed, so that the roller 77 may be driven by either the drive from the timing belt 90 or the drive from the leader-transport motor M3, independently of each other.

On the other hand, inside the film collecting/storing holder 5, there is provided a storage chamber 53 having a doughnut-like space for accommodating the film strips 3 introduced by the roller 62. This storage chamber 53 and the outside of the holder are communicated with each other through the film passage 51*c* formed in the projection 51.

At those portions of the film passage 51*c* and the storage chamber 53 where the image-bearing areas of the film strips 3 are caused to pass, there is provided a groove 5*a* for preventing frictional damage.

Next, operations of the film developing apparatus 1 having the above-described construction will be specifically described.

When two cartridges 2 each accommodating the film strip 3 having its leading end joined to the leader 8 are set inside the film developing apparatus, the film strips 3 are retrieved from the respective cartridges 2 by means of the roller 10' of the film retrieving section O. Then, the films are advanced to the developing section D. With withdrawal of the film strips from the cartridge 2 by a length corresponding to one film roll respectively, with a cutting instruction from the control device C, the cutters 11 provided respectively for the two film strips 3 cut the terminal ends of the film strips 3, thereby to separate the film strips 3 from the respective cartridges 2.

At the next developing section D, the films 3 undergo a developing process with their successive passage through the six processing tanks 4.

With completion of the developing process, the films 3 are sent to the drying section K to be dried.

Figure 18:
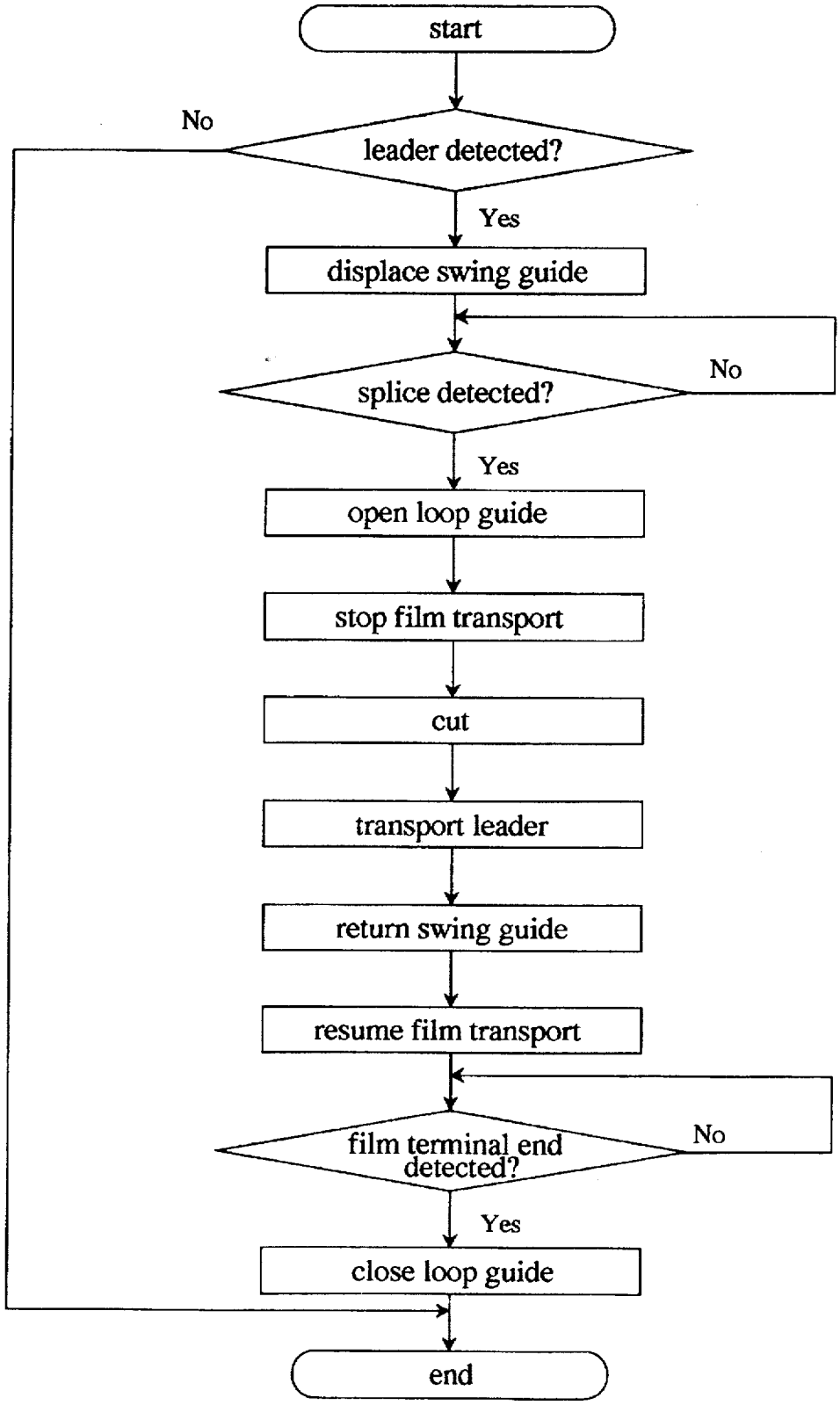
FIG. 18 is a flow chart illustrating operations of the film developing apparatus of FIG. 13.

After completion of the drying process, as the optical sensor S1 detects the leader 8, the control device C initiates a cutting and collecting process for the leader 8, which process is illustrated by a flow chart in FIG. 18.

With the detection of the leader 8 by the optical sensor S1, the solenoid 12 is turned 'ON' to displace the swing guide 13 from the transport passage of the films 3.

Next, when the optical sensors S2, S3 detect the respective splice portions 8*b*, the loop-guide drive motor M1 is energized to open the loop guide 73; and after lapse of a predetermined time period subsequent to the detection of the splice portions 8*b*, the electromagnetic clutch 91 is disengaged to stop those film transport rollers positioned on the downstream side of the transport passage of the films 3 relative to the roller 74. Incidentally, the time period until the disengagement of the electromagnetic clutch 91 is set to a time period required for portions of the films slightly rearwardly of the splice portions 8*b* to reach the position of the cutter 7.

After the stoppage of the transport of the films 3 on the downstream side relative to the roller 74, the film strips 3 are accumulated in the looped-form at the position of the loop guide 73.

After the transport rollers are stopped by turning off the electromagnetic clutch 91, the cutter-drive motor M2 is activated to cut the films 3.

After the leader 8 is cut off the films 3, the leader-transport motor M3 is energized for a predetermined period of time to drop the cut leader 8 into the leader collecting box 14.

Next, the solenoid 12 is turned 'OFF' to return the swing guide 13 to the position extending along the transport passage of the films 3. Thereafter, the electromagnetic clutch 91 is turned 'ON' to resume the transport operation of the films 3.

As the two film strips 3 have been transported by a length each corresponding to one film roll amount and both of the optical sensors S4, S5 detect the terminal ends of the respective film strips 3, the loop-guide drive motor M1 is energized to close the loop guide 73 to the posture extending along the transport passage of the films 3.

The transported film strips 3 are caused to pass the swing guide 13 and sent into the film collecting/storing holder 5 by means of the roller 62. And, as being guided along the inner wall of the film collecting/storing holder 5, the film strips are collected therein in the form of rolls. In this condition, the respective terminal ends of both of the two film strips 3 slightly project from the projection 51 of the film collecting/storing holder 5.

After completion of the collection of the films 3 into the film collecting/storing holder 5, an operator presses an approximate upper end region of the support arm 61*b* of the holder support 61 in the direction opposite to the direction of the arrow B thereby to release the engagement between the holder 5 and the apparatus body 1. Then, the operator may carry the detached holder 5 to a location of the next process.

Conversely, for attaching the film collecting/storing holder 5 to the film developing apparatus body 1, with keeping the approximate upper end region of the support arm 61*b* pressed in the direction opposite to the direction of the arrow B the operator will insert the projection 51 into the opening 6*a* of the exit 6.

Accordingly, the control device C, swing guide 13 and the solenoid 12 for driving the swing guide 13 together function as exhaust means F for exhausting the leader 8 away from the transport passage of the films 3.

(10) In the foregoing embodiment, the two film strips are joined to the leader 8. Instead, one or more than three film strips may be joined to the leader 8 to be developed.

(11) In the above embodiment, the exhaust means F comprises the swing guide 13 and so on. Instead, it is also conceivable to effect the exhaust operation by air-blowing the cut leader 8 away from the transport passage of the film strips 3.

(12) In the foregoing embodiment, the collection in the form of roll of the films 3 within the film collecting/storing holder 5 is effected by sending the films 3 into the holder by means of the roller 62. This roll-collecting operation of the films 3 into the holder 5 may be effected by providing, inside the film collecting/storing holder 5, a sprocket capable of catching the perforations of the films 3 to wind these films 3.

(13) In the above embodiment, the cutter 7 for cutting the films 3 from the leader 8 comprises the combination of the upper blade 7*a* and the lower blade 7*b*. Instead, the films and the leader may be cut from each other by means of a laser beam or the like.

The invention may be embodied in other specific forms without departing from the spirit or essential characteristics hereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A photographic film developing apparatus comprising:

a developing section including a developing tank for developing a photographic film strip;

a drying section for drying the developed film strip, said drying section including an exit for discharging the dried film strip and a holder support disposed adjacent to said exit;

a film collecting/storing holder disposed adjacent to and detachably attached to said exit of the drying section by said holder support, said film collecting/storing holder including a storage space for collecting and storing the dried film strip from said drying section;

wherein said film collecting/storing holder includes:

a projection insertable into said exit of the drying section, said projection defining a film passage communicating between said exit of the drying section and said storage space of the film collecting/storing holder; ad a film rolling means for rolling the film strip for the storage thereof within said storage space of the holder, said film rolling means including a winder means disposed inside said film collecting/storing holder and having a projection engageable with a hole defined in a film transport guide leader joined to the film strip and drive means for driving said winder means for rotation, said drive means receiving a driving force from said drying section.

2. A film developing apparatus as defined in claim 1, wherein said film rolling means comprises a guide face formed inside said storage space of the film collecting/storing holder for guiding the film strip introduced into said holder, said guide face having a loop-like cross section.

3. A film developing apparatus as defined in claim 1, wherein said film rolling means includes a winder means having teeth engageable with a perforation of the film strip introduced into said holder and a drive means for driving said winder means for rotation, said drive means receiving a driving force from said drying section.

4. A film developing apparatus as defined in claim 1, further comprising a film sensor for detecting presence/ absence of the film strip, said film sensor being disposed on an upstream side of a transport passage of the film strip relative to a roller for sending the film strip into said film collecting/storing holder.

5. A photographic film developing apparatus comprising:

a film retrieving section for retrieving a photographic film strip from a cartridge;

a developing section including a plurality of developing tanks for developing the photographic film strip;

a drying section for drying the developed film strip;

a control device for controlling operations of components including said retrieving section, developing section and said drying section;

a film collecting/storing holder detachably disposed adjacent an exit of the drying section for collecting and storing the dried film strip from said drying section;

a cutter disposed adjacent the exit of said drying section for cutting a film transport guide leader joined to the film strip off this film strip;

an exhaust means for exhausting the cut leader away from a film transport path; and film rolling means for collecting the film strip inside said film collecting/storing holder with the film strip being rolled.

6. A film developing apparatus as defined in claim 5, wherein said film rolling means comprises a guide face formed inside said film collecting/storing holder for guiding the film strip introduced into said holder, said guide face having a loop-like cross section.

7. A film developing apparatus as defined in claim 5, wherein said film rolling means includes a winder means having teeth engageable with a perforation of the film strip introduced into said holder and a drive means for driving said winder means for rotation.

8. A film developing apparatus as defined in claim 5, further comprising a film sensor for detecting presence/absence of the film strip, said sensor being disposed on an upstream side of a transport passage of the film strip relative to a roller for sending the film strip into said film collecting/storing holder.

9. A photographic film developing apparatus comprising:

a developing section including a developing tank for developing a photographic film strip;

a drying section for drying the developed film strip, said drying section including an exit for discharging the dried film strip and a holder support disposed adjacent said exit; and a film collecting/storing holder disposed adjacent and detachably attached to said exit of the drying section by said holder support, said film collecting/storing holder including a storage space for collecting and storing the dried film strip from said drying section;

wherein said film collecting/storing holder includes:

a projection insertable into said exit of the drying section, said projection defining a film passage communicating between said exit of the drying section and said storage space of the film collecting/storing holder, and a film rolling means for rolling the film strip for the storage thereof within said storage space of the holder, said film rolling means including a guide face formed inside said storage space of the film collecting/storing holder for guiding the film strip introduced into said holder, said guide face having a loop-like cross section.

10. A photographic film developing apparatus comprising:

a developing section including a developing tank for developing a photographic film strip;

a drying section for drying the developed film strip, said drying section including an exit for discharging the dried film strip and a holder support disposed adjacent said exit; and a film collecting/storing holder disposed adjacent and detachably attached to said exit of the drying section by said holder support, said film collecting/storing holder including a storage space for collecting and storing the dried film strip from said drying section;

wherein said film collecting/storing holder includes:

a projection insertable into said exit of the drying section, said projection defining a film passage communicating between said exit of the drying section and said storage space of the film collecting/storing holder, and a film rolling means for rolling the film strip for the storage thereof within said storage space of the holder, said film rolling means including a winder means having teeth engageable with a perforation of the film strip introduced into said holder and a drive means for driving said winder means for rotation, said drive means receiving a driving force from said drying unit.

11. A photographic film developing apparatus comprising:

a developing section including a developing tank for developing a photographic film strip;

a drying section for drying the developed film strip, said drying section including an exit for discharging the dried film strip and a holder support disposed adjacent said exit;

a film collecting/storing holder disposed adjacent and detachably attached to said exit of the drying section by said holder support, said film collecting/storing holder including a storage space for collecting and storing the dried film strip for said drying section;

wherein said film collecting/storing holder includes:

a projection insertable into said exit of the drying section, said projection defining a film passage communicating between said exit of the drying section and said storage space of the film collecting/storing holder, and a film rolling means for rolling the film strip for the storage thereof within said storage space of the holder; and a film sensor for detecting presence/absence of the film strip, said film sensor being disposed on an upstream side of a transport passage of the film strip relative to a roller for sending the film strip into said film collecting/storing holder.

12. A photographic film developing apparatus comprising:

a developing section including a developing tank for developing a photographic film strip;

a drying section drying the developed film strip;

a cutter disposed adjacent an exit of said drying section for cutting a film transport guide leader joined to the film strip off this film strip; and an exhaust means for exhausting the cut leader away from a film transport path;

wherein said exhaust means includes:

a control device for providing a cutting instruction to said cutter, and a swing guide fixed to a drive shaft of a solenoid and disposed on the downstream side of the transport passage of the film strip relative to said cutter, said swing guide being pivotable in response to actuation of said solenoid.

* * * * *